US008652724B2

(12) United States Patent
Wada

(10) Patent No.: US 8,652,724 B2
(45) Date of Patent: Feb. 18, 2014

(54) TONER FOR DEVELOPING ELECTROSTATIC IMAGES AND METHOD FOR PRODUCING THE SAME

(75) Inventor: Azusa Wada, Tokyo (JP)

(73) Assignee: Zeon Corporation, Tokyo (JP)

( * ) Notice: Subject to any disclaimer, the term of this patent is extended or adjusted under 35 U.S.C. 154(b) by 0 days.

(21) Appl. No.: 13/303,777

(22) Filed: Nov. 23, 2011

(65) Prior Publication Data

US 2012/0135344 A1 May 31, 2012

(30) Foreign Application Priority Data

Nov. 30, 2010 (JP) ..... 2010-267600

(51) Int. Cl.
*G03G 9/00* (2006.01)

(52) U.S. Cl.
USPC ..... 430/108.4; 430/108.1; 430/108.8

(58) Field of Classification Search
USPC ..... 430/108.1, 108.4, 108.8, 109.1, 109.3
See application file for complete search history.

(56) References Cited

U.S. PATENT DOCUMENTS

| | | | | |
|---|---|---|---|---|
| 4,840,863 | A * | 6/1989 | Otsu et al. | 430/108.22 |
| 5,102,764 | A * | 4/1992 | Rossi et al. | 430/108.21 |
| 7,314,695 | B2 * | 1/2008 | Harada et al. | 430/108.22 |
| 2009/0103950 | A1 * | 4/2009 | Nakayama et al. | 399/252 |

FOREIGN PATENT DOCUMENTS

| | | | |
|---|---|---|---|
| JP | 6-027733 | A | 2/1994 |
| JP | 2006-215312 | A | 8/2006 |

* cited by examiner

*Primary Examiner* — Stewart Fraser
(74) *Attorney, Agent, or Firm* — Westerman, Hattori, Daniels & Adrian, LLP

(57) ABSTRACT

The present invention is to provide a toner for developing electrostatic images having a low minimum fixing temperature, and high hot offset resistance and high heat-resistant shelf stability, and a method for producing the toner. Also, the present invention is to provide a toner for developing electrostatic images, comprising a binder resin, a colorant, a release agent and a retention aid, wherein the retention aid is a copolymer of 70 to 98% by weight styrene and 2 to 30% by weight (meth)alkyl acrylate, and the copolymer has a glass transition temperature of 5 to 60° C.

4 Claims, No Drawings

TONER FOR DEVELOPING ELECTROSTATIC IMAGES AND METHOD FOR PRODUCING THE SAME

TECHNICAL FIELD

The present invention relates to a toner for developing electrostatic images (hereinafter, it may be simply referred to as "toner") used for development of electrostatic latent images in the electrophotography, the electrostatic recording method, the electrostatic printing method or the like. The present invention also relates to a method for producing the toner for developing electrostatic images.

BACKGROUND ART

In the electrophotography, a method which uses a heat roller has been widely employed in order to fix electrostatic latent images which are visualized by a toner. In this method, there has been a desire for a toner having excellent low-temperature fixability (that is, the toner has a low minimum fixing temperature) and a wide fixing temperature range.

If offset is caused on the heat roller, the fixing temperature range is referred to as the difference ($T_0$-$T_L$) between hot offset temperature ($T_0$) and the minimum fixing temperature ($T_L$). Generally, if a polymer having a low molecular weight is used as a binder resin, the minimum fixing temperature and hot offset temperature decrease; moreover, shelf stability lowers. On the other hand, if a polymer having a high molecular weight is used as a binder resin, hot offset temperature increases and shelf stability is improved; however, there is a problem that the minimum fixing temperature increases.

As a means for solving the issue causing the relationship between the hot offset temperature and shelf stability and the minimum fixing temperature is traded-off, a binder resin composition containing a mixture (composition) of a high molecular weight polymer and a low molecular weight polymer, each of which has a different molecular weight distribution, has been known (Patent Literature 1).

As one of other means, there has been disclosed a toner having an inner layer containing a radical polymer resin, a colorant and a release agent, and a toner outer layer containing a grafted polyester resin formed by graft-polymerizing a radical polymerizable monomer on a polyester having unsaturated bonds in a main chain (Patent Literature 2). The above literature discloses the toner having excellent hot offset resistance, an appropriate fixable temperature range and excellent heat-resistant shelf stability.

CITATION LIST

Patent Literature

Patent Literature 1: Japanese Patent Application Laid-Open (JP-A) No. H6-27733
Patent Literature 2: JP-A No. 2006-215312

SUMMARY OF INVENTION

Technical Problem

In the binder resin composition disclosed in Patent Literature 1, a low molecular weight polymer having a sharp molecular weight distribution is added to decrease in the minimum fixing temperature, resulting in a increase a toner fixing temperature range. However, the composition has no sufficient balance between the minimum fixing temperature and hot offset temperature.

In addition, the toner disclosed in Patent Literature 2 has no problem with the fixing temperature range and heat-resistant shelf stability; however, it has insufficient hot offset resistance. In addition, there has been a problem that the toner requires multistep production processes.

The present invention is to simply provide a toner for developing electrostatic images having a low minimum fixing temperature, high hot offset resistance and heat-resistant shelf stability. Also, the present invention is to provide a toner which provides high-gloss printouts in a wide fixing temperature range.

Solution to Problem

As a result of diligent researches, the inventors of the present invention have found out that the above object can be attained by using a toner for developing electrostatic images comprising a binder resin, a colorant, a release agent and a retention aid which is a copolymer of a combination of specific monomers and has a glass transition temperature in a specific range.

That is, the toner for developing electrostatic images is a toner for developing electrostatic images comprising a binder resin, a colorant, a release agent and a retention aid, wherein the retention aid is a copolymer of 70 to 98% by weight styrene and 2 to 30% by weight (meth)alkyl acrylate, and the copolymer has a glass transition temperature of 5 to 60° C.

In the present invention, it is preferable that the retention aid has a weight average molecular weight (Mw) of 3,000 to 10,000 and a molecular weight distribution (Mw/Mn) of 1.0 to 2.0, which is a ratio of weight average molecular weight (Mw) to number average molecular weight (Mn).

In the present invention, it is preferable that an added amount of the retention aid is in the range from 1 to 15 parts by weight with respect to 100 parts by weight of the binder resin.

In the present invention, it is preferable that the release agent contains an ester wax.

In the present invention, it is preferable that the ester wax is a polyfunctional ester wax having an acid value of 2 mg KOH/g or less and a hydroxyl value of 15 mg KOH/g or less.

In the present invention, it is preferable that the release agent contains a hydrocarbon wax.

The method for producing the toner for developing electrostatic images of the present invention is a method comprising the steps of obtaining a suspension in which droplets of a polymerizable monomer composition comprising a polymerizable monomer, a colorant, a release agent and a retention aid are dispersed, by suspending the polymerizable monomer composition in an aqueous dispersion medium containing a dispersion stabilizer, and obtaining colored resin particles comprising a binder resin by suspension polymerization of the suspension in the presence of a polymerization initiator, wherein the retention aid is a copolymer of 70 to 98% by weight styrene and 2 to 30% by weight (meth)alkyl acrylate, and the copolymer has a glass transition temperature of 5 to 60° C.

Advantageous Effects of Invention

The toner for developing electrostatic images according to the present invention is a toner which is mixed with a retention aid that comprises a styrene monomer and a (meth)alkyl acrylate monomer and has a glass transition temperature in a specific range, thereby having excellent heat-resistant shelf stability, low-temperature fixability and hot offset resistance, and providing a smooth printing surface and high-gloss printouts.

DESCRIPTION OF EMBODIMENTS

The toner for developing electrostatic images is a toner for developing electrostatic images comprising a binder resin, a colorant, a release agent and a retention aid, wherein the retention aid is a copolymer of 70 to 98% by weight styrene and 2 to 30% by weight (meth)alkyl acrylate, and the copolymer has a glass transition temperature of 5 to 60° C.

Hereinafter, the toner for developing electrostatic images (hereinafter, it may be simply referred to as "toner") of the present invention will be described.

The toner of the present invention comprises a binder resin, a colorant, a release agent and a predetermined retention aid.

Hereinafter, a method for producing colored resin particles used in the present invention, colored resin particles obtained by the production method, a method for producing the toner of the present invention using the colored resin particles, and the toner of the present invention will be described in this order.

1. Method for Producing Colored Resin Particles

Generally, methods for producing the colored resin particles are broadly classified into dry methods such as a pulverization method and wet methods such as an emulsion polymerization agglomeration method, a suspension polymerization method and a solution suspension method. The wet methods are preferable since toners having excellent printing characteristic such as the image reproducibility can be easily obtained. Among the wet methods, polymerization methods such as the emulsion polymerization agglomeration method and the suspension polymerization method are preferable since toners which have relatively small particle size distribution in micron order can be easily obtained. Among the polymerization methods, the suspension polymerization method is more preferable.

The emulsion polymerization agglomeration method is a method for producing colored resin particles by polymerizing emulsified polymerizable monomers to obtain a resin microparticle emulsion, and aggregating the resultant resin microparticle with a colorant dispersion liquid, etc. The solution suspension method is a method for producing colored resin particles by forming droplets of a solution in an aqueous medium, the solution in which toner components such as a binder resin and a colorant are dissolved or dispersed in an organic solvent, and removing the organic solvent. Both methods can be performed by known methods.

The colored resin particles of the present invention can be produced by employing the wet methods or the dry methods. The suspension polymerization method preferable among the wet methods is performed by the following processes.

(A) Suspension Polymerization Method (A-1) Preparation Process of Polymerizable Monomer Composition First, a polymerizable monomer, a colorant, a release agent, a retention aid and other additives such as a charge control agent and the like, which are added if required, are mixed to prepare a polymerizable monomer composition. For example, a media type dispersing machine is used for the mixing upon preparing the polymerizable monomer composition.

In the present invention, the polymerizable monomer means a monomer having a polymerizable functional group and the polymerizable monomer is polymerizable to be a binder resin. As a main component of the polymerizable monomer, a monovinyl monomer is preferably used. Examples of the monovinyl monomer include: styrene; styrene derivatives such as vinyl toluene and α-methylstyrene; acrylic acid and methacrylic acid; acrylic acid esters such as methyl acrylate, ethyl acrylate, propyl acrylate, butyl acrylate, 2-ethylhexyl acrylate and dimethylaminoethyl acrylate; methacrylic acid esters such as methyl methacrylate, ethyl methacrylate, propyl methacrylate, butyl methacrylate, 2-ethylhexyl methacrylate and dimethylaminoethyl methacrylate; nitrile compounds such as acrylonitrile and methacrylonitrile; amide compounds such as acrylamide and methacrylamide; and olefins such as ethylene, propylene and butylene. These monovinyl monomers may be used alone or in combination of two or more kinds. Among them, styrene, styrene derivatives, and acrylic acid esters or methacrylic acid esters are suitably used for the monovinyl monomer.

In order to improve the hot offset and shelf stability, it is preferable to use any crosslinkable polymerizable monomer together with the monovinyl monomer. The crosslinkable polymerizable monomer means a monomer having two or more polymerizable functional groups. Examples of the crosslinkable polymerizable monomer include: aromatic divinyl compounds such as divinyl benzene, divinyl naphthalene and derivatives thereof; ester compounds such as ethylene glycol dimethacrylate and diethylene glycol dimethacrylate, in which two or more carboxylic acids are esterified to alcohol having two or more hydroxyl groups; other divinyl compounds such as N,N-divinylaniline and divinyl ether; and compounds having three or more vinyl groups. These crosslinkable polymerizable monomers can be used alone or in combination of two or more kinds.

In the present invention, it is desirable that the amount of the crosslinkable polymerizable monomer to be used is generally in the range from 0.1 to 5 parts by weight, preferably from 0.3 to 2 parts by weight, with respect to 100 parts by weight of the monovinyl monomer.

Further, it is preferable to use macromonomer as part of the polymerizable monomer since the balance of the shelf stability and low-temperature fixability of the toner to be obtained can be improved. The macromonomer is a reactive oligomer or polymer having a polymerizable carbon-carbon unsaturated double bond at the end of a polymer chain and generally having a number average molecular weight of 1,000 to 30,000. As the macromonomer, it is preferable to provide a polymer having higher glass transition temperature (hereinafter may be referred to as "Tg") than that of a polymer obtained by polymerization of the monovinyl monomer. The macromonomer to be used is preferably in the range from 0.03 to 5 parts by weight, more preferably from 0.05 to 1 part by weight, with respect to 100 parts by weight of the monovinyl monomer.

In order that the toner to be produced has excellent heat-resistant shelf stability, low-temperature fixability and hot offset resistance, and provides a smooth printing surface and high-gloss printouts, a retention aid is further used for the polymerizable monomer composition, which is a copolymer of 70 to 98% by weight styrene and 2 to 30% by weight (meth)alkyl acrylate, the copolymer having a glass transition temperature of 5 to 60° C. In the present invention, "(meth) acrylic acid" collectively refers to acrylic acid and methacrylic acid.

If a ratio of a styrene monomer contained in the retention aid is less than 70% by weight, as described in Comparative example 2 that will be described hereinafter, there could be an excessive decrease in hot offset temperature. If the content ratio of the styrene monomer is too low, as just described above, there could be provided a less glossy appearance in printouts, particularly when the fixing temperature is relatively high.

On the other hand, if a ratio of a (meth)alkyl acrylate monomer contained in the retention aid is less than 2% by weight, as described in Comparative example 1 that will be described hereinafter, there could be an excessive increase in minimum fixing temperature. If the content ratio of the (meth) alkyl acrylate monomer is too low, as just described above, there could be provided a less glossy appearance in printouts, particularly when the fixing temperature is relatively low.

In the copolymer, the content ratio of the styrene monomer is preferably in the range from 80 to 95% by weight, and the content ratio of the (meth)alkyl acrylate monomer is preferably in the range from 5 to 20% by weight.

Examples of the (meth)alkyl acrylate monomer in the retention aid include (meth)alkyl acrylate monomers having an alkyl site such as a methyl group, an ethyl group, an n-propyl group, an isopropyl group, an n-butyl group, an isobutyl group, a sec-butyl group, a tert-butyl group, an n-pentyl group, a sec-pentyl group, an isopentyl group, an neopentyl group, an n-hexyl group, an isohexyl group, an neohexyl group, a sec-hexyl group or a tert-hexyl group. Preferred is (meth)alkyl acrylate having an alkyl site such as an ethyl group, an n-propyl group, an isopropyl group or an n-butyl, and more preferred is n-butyl acrylate.

If the glass transition temperature of the retention aid is less than 5° C., there could be an excessive decrease in hot offset temperature and an excessive increase in minimum fixing temperature. If the glass transition temperature is too low, as just described above, there could be provided a less glossy appearance in printouts, particularly when the fixing temperature is relatively high.

On the other hand, if the glass transition temperature of the retention aid exceeds 60° C., there could be an excessive increase in minimum fixing temperature. If the glass transition temperature is too high, as just described above, there could be provided a less glossy appearance in printouts, particularly when fixing temperature is relatively low.

The glass transition temperature of the retention aid is preferably in the range from 10 to 55° C., more preferably from 20 to 50° C. If the glass transition temperature of the retention aid is within the above range, the retention aid may contain other monomers other than the styrene monomer and the (meth)alkyl acrylate monomer.

The weight average molecular weight (Mw) of the retention aid is preferably in the range from 3,000 to 10,000, and the molecular weight distribution (Mw/Mn) which is the ratio of weight average molecular weight (Mw) to number average molecular weight (Mn) is preferably in the range from 1.0 to 2.0, more preferably from 1.0 to 1.4.

If the weight average molecular weight (Mw) of the retention aid is less than 3,000, the weight average molecular weight is too low, so that there could be a decrease in heat-resistant shelf stability.

On the other hand, if the weight average molecular weight (Mw) of the retention aid exceeds 10,000, the weight average molecular weight is too high, so that high gloss of printouts may not be obtained in a wide temperature range.

The weight average molecular weight is preferably in the range from 3,500 to 8,000, more preferably from 4,000 to 6,000.

If the molecular weight distribution (Mw/Mn) of the retention aid exceeds 2.0, the molecular weight distribution is too wide, so that there could be a decrease in low-temperature fixability of the toner, particularly. Furthermore, there could be a decrease in glossy appearance in printouts.

The molecular weight distribution is preferably in the range from 1.0 to 1.5, more preferably from 1.0 to 1.3.

As described above, the retention aid which comprises the styrene monomer and the (meth)alkyl acrylate monomer and has the glass transition temperature in a specific range is added to the polymerizable monomer composition; thereby, the toner which has excellent heat-resistant shelf stability, low-temperature fixability and hot offset resistance and provides a smooth printing surface and high-gloss printouts can be obtained.

The added amount of the retention aid is preferably in the range from 1 to 15 parts by weight with respect to 100 parts by weight of the binder resin.

If the added amount of the retention aid is less than 1 part by weight, the added amount of the retention aid is too small, so that the above-described effect of the present invention cannot be obtained. Furthermore, if the added amount of the retention aid exceeds 15 parts by weight, there could be a decrease in heat-resistant shelf stability.

The added amount of the retention aid is preferably in the range from 2 to 12 parts by weight, more preferably from 3 to 8 parts by weight, with respect to 100 parts by weight of the binder resin.

As the copolymer of the styrene monomer and the (meth) alkyl acrylate monomer, which is the retention aid used in the present invention and has the glass transition temperature in a specific range, a commercial available copolymer can be used. The copolymer can be produced by any known method such as a solution polymerization method, an aqueous solution polymerization method, an ion polymerization method, a high temperature and high pressure polymerization method, a suspension polymerization method or the like. In particular, from the viewpoint of ease of performing a polymerization and controlling the degree of polymerization, it is preferable to produce the copolymer by an anionic polymerization method or a high temperature and high pressure polymerization method (for example, see U.S. Pat. No. 6,355,727, etc.).

In the present invention, a colorant is used. To produce a color toner, a black colorant, a cyan colorant, a yellow colorant and a magenta colorant can be used.

Examples of the black colorant to be used include carbon black, titanium black, magnetic powder such as zinc-iron oxide and nickel-iron oxide.

Examples of the cyan colorant to be used include copper phthalocyanine compounds, derivatives thereof and anthraquinone compounds. The specific examples include C. I. Pigment Blue 2, 3, 6, 15, 15:1, 15:2, 15:3, 15:4, 16, 17:1 and 60.

Examples of the yellow colorant to be used include compounds including azo pigments such as monoazo pigments and disazo pigments, and condensed polycyclic pigments. The specific examples include C. I. Pigment Yellow 3, 12, 13, 14, 15, 17, 62, 65, 73, 74, 83, 93, 97, 120, 138, 155, 180, 181, 185, 186 and 213.

Examples of the magenta colorant to be used include compounds including azo pigments such as monoazo pigments and disazo pigments, and condensed polycyclic pigments. The specific examples include C. I. Pigment Red 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209, 213, 237, 238, 251, 254, 255 and 269, and C. I. Pigment Violet 19.

In the present invention, these colorants can be used alone or in combination of two or more kinds. The amount of the colorant is preferably in the range from 1 to 10 parts by weight with respect to 100 parts by weight of the monovinyl monomer.

From the viewpoint of improving the releasing characteristics of the toner from a fixing roller at fixing, the release agent is added to the polymerizable monomer composition. The release agent can be used without any particular limitation as long as it is generally used as a release agent for the toner.

The release agent preferably contains an ester wax and/or a hydrocarbon wax. By using the above waxes as the release agents, the balance of low-temperature fixability and shelf stability can be improved.

In the present invention, as the ester wax which is suitably used as the release agent, a polyfunctional ester wax is more suitable. The examples include: pentaerythritol ester compounds such as pentaerythritol tetrapalmitate, pentaerythritol tetrabehenate and pentaerythritol tetrastearate; glycerin ester compounds such as hexaglycerin octabehenate, pentaglycerin heptabehenate, tetraglycerin hexabehenate, triglycerin pentabehenate, diglycerin tetrabehenate and glycerintribehenate; and dipentaerythritol ester compounds such as dipentaerythritol hexamyristate and dipentaerythritol hexapalmitate. Among them, glycerin ester compounds are preferable, pentaerythritol tetrapalmitate, hexaglycerin octabehenate, tetraglycerin hexabehenate, and triglycerin pentabehenate are more preferable, and hexaglycerin octabehenate is particularly preferable.

An acid value of the ester wax is preferably 2 mg KOH/g or less, more preferably 1 mg KOH/g or less, and further more preferably 0.5 mg KOH/g or less. The acid value of the ester wax is a value measured with reference to JOCS 2.3.1-96, using JOCS Standard Methods for the Analysis of Fats, Oils and Related Materials that is enacted by Japan Oil Chemists' Society (JOCS).

If the acid value of the ester wax exceeds the above upper limit, unreacted carboxylic acid groups derived from fatty acid are remained in the ester wax. Therefore, in the droplets forming process, it becomes difficult to form stable droplets of the polymerizable monomer composition, so that the colored resin particles have an adverse effect on characteristics of particle diameter, and a deterioration in image quality due to fog or the like is likely to occur; moreover, volatiles may be generated when the toner is fixed, thereby causing odors.

In the present invention, a hydroxyl value of the ester wax is preferably 15 mg KOH/g or less, more preferably 10 mg KOH/g or less, and further preferably 5 mg KOH/g or less. The hydroxyl value of the ester wax is a value measured with reference to JOCS 2.3.6.2-96, using JOCS Standard Methods for the Analysis of Fats, Oils and Related Material that is enacted by Japan Oil Chemists' Society (JOCS).

If the hydroxyl value of the ester wax exceeds the above upper limit, unreacted hydroxyl groups derived from materials are remained in the ester wax. Therefore, in the droplets forming process, it becomes difficult to form stable droplets of the polymerizable monomer composition, so that the colored resin particles have an adverse effect on characteristics of particle diameter, and a deterioration in image quality due to fog or the like may be likely to occur, or environmental stability may be deteriorated.

Examples of the hydrocarbon wax suitably used as the release agent in the present invention include a polyethylene wax, a polypropylene wax, a Fischer-Tropsch wax, a petroleum wax and the like. Preferred are a Fischer-Tropsch wax and a petroleum wax, and more preferred is a petroleum wax.

The number average molecular weight of the hydrocarbon wax is preferably in the range from 300 to 800, more preferably from 400 to 600. A needle penetration of the hydrocarbon wax measured with reference to JIS K2235 5.4 is preferably in the range from 1 to 10, more preferably from 2 to 7.

The "petroleum wax" is produced by the purification process of petroleum and means one which contains saturated hydrocarbon having a side chain as a main component and is a solid at normal temperature. In JIS K 2235, the petroleum wax is broadly divided into 3 categories including a paraffin wax, a microcrystalline wax and a petrolatum. In the present invention, at least one category is selected from the above 3 categories, and the selected one is preferably used as a component of the release agent. Among petroleum waxes, a paraffin wax and a microcrystalline wax are more preferable, from the viewpoint of improving the balance of the low-temperature fixability and shelf stability of the toner.

In addition to the above release agents, natural waxes such as jojoba and mineral waxes such as ozokerite can be used, for example.

These release agents may be used alone or in combination of two or more kinds.

The amount of the release agent to be used is preferably in the range from 0.1 to 30 parts by weight, more preferably from 1 to 20 parts by weight, with respect to 100 parts by weight of the monovinyl monomer.

As one of other additives, a charge control agent having positively charging ability or negatively charging ability can be used to improve the charging ability of the toner.

The charge control agent is not particularly limited as long as it is generally used as a charge control agent for the toner. Among the charge control agents, a charge control resin having positively charging ability or negatively charging ability is preferably used since the charge control resin is highly compatible with the polymerizable monomer and can impart stable charging ability (charge stability) to the toner particles. From the viewpoint of obtaining a positively-chargeable toner, the charge control resin having positively charging ability is more preferably used.

Examples of the charge control agent having positively charging ability include a nigrosine dye, a quaternary ammonium salt, a triaminotriphenylmethane compound, an imidazole compound, a polyamine resin preferably used as the charge control resin, a quaternary ammonium group-containing copolymer and a quaternary ammonium salt group-containing copolymer.

The examples of the charge control agent having negatively charging ability include: an azo dye containing metal such as Cr, Co, Al and Fe; a metal salicylate; a metal alkylsalicylate; and a sulfonic acid group-containing copolymer, a sulfonic acid base-containing copolymer, a carboxylic acid group-containing copolymer and a carboxylic acid base-containing copolymer which are preferably used as the charge control resin.

In the present invention, it is desirable that the amount of the charge control agent to be used is generally in the range from 0.01 to 10 parts by weight, preferably from 0.03 to 8 parts by weight, with respect to 100 parts by weight of the monovinyl monomer. If the added amount of the charge control agent is less than 0.01 part by weight, fog may occur. On the other hand, if the added amount of the charge control agent exceeds 10 parts by weight, printing soiling may occur.

As one of other additives, a molecular weight modifier is preferably used upon the polymerization of the polymerizable monomer which is polymerized to be a binder resin.

The molecular weight modifier is not particularly limited as long as it is generally used as a molecular weight modifier for the toner. Examples of the molecular weight modifier include: mercaptans such as t-dodecyl mercaptan, n-dodecyl mercaptan, n-octyl mercaptan and 2,2,4,6,6-pentamethylheptane-4-thiol; and thiuram disulfides such as tetramethyl thiuram disulfide, tetraethyl thiuram disulfide, tetrabutyl thiuram disulfide, N,N'-dimethyl-N,N'-diphenyl thiuram disulfide and N,N'-dioctadecyl-N,N'-diisopropyl thiuram disulfide. These molecular weight modifiers may be used alone or in combination of two or more kinds.

In the present invention, it is desirable that the amount of the molecular weight modifier to be used is generally in the range from 0.01 to 10 parts by weight, more preferably from 0.1 to 5 parts by weight, with respect to 100 parts by weight of the monovinyl monomer.

(A-2) Suspension Process of Obtaining Suspension (Droplets Forming Process)

In the present invention, the polymerizable monomer composition comprising at least a polymerizable monomer, colorant, a release agent and a retention aid is dispersed in an aqueous medium containing a dispersion stabilizer, and the polymerization initiator is added therein. Then, the droplets of the polymerizable monomer composition are formed. The method for forming droplets is not particularly limited. The droplets are formed by means of a device capable of strong stirring such as an in-line type emulsifying and dispersing machine (product name: MILDER; manufactured by Ebara Corporation), and a high-speed emulsification dispersing machine (product name: T. K. HOMOMIXER MARK II; manufactured by PRIMIX Corporation).

Examples of the polymerization initiator include: persulfates such as potassium persulfate and ammonium persulfate; azo compounds such as 4,4'-azobis(4-cyanovaleric acid), 2,2'-azobis(2-methyl-N-(2-hydroxyethyl)propionamide), 2,2'-azobis(2-amidinopropane)dihydrochloride, 2,2'-azobis (2,4-dimethylvaleronitrile) and 2,2'-azobisisobutyronitrile; and organic peroxides such as di-t-butylperoxide, benzoylperoxide, t-butylperoxy-2-ethylhexanoate, t-hexylperoxy-2-ethylbutanoate, diisopropylperoxydicarbonate, di-t-butylperoxyisophthalate and t-butylperoxyisobutyrate. These can be used alone or in combination of two or more kinds. Among them, the organic peroxides are preferably used since it can reduce residual polymerizable monomer and has excellent printing durability.

Among the organic peroxides, preferred is peroxy ester, and more preferred is non-aromatic peroxy ester, i.e. peroxy ester having no aromatic ring, since they have excellent initiator efficiency and can reduce a residual polymerizable monomer.

The polymerization initiator may be added after dispersing the polymerizable monomer composition to the aqueous medium and before forming droplets as described above, or may be added to the polymerizable monomer composition before being dispersed in the aqueous medium.

The added amount of the polymerization initiator used in the polymerization of the polymerizable monomer composition is preferably in the range from 0.1 to 20 parts by weight, more preferably from 0.3 to 15 parts by weight, furthermore preferably from 1 to 10 parts by weight, with respect to 100 parts by weight of the monovinyl monomer.

In the present invention, the aqueous medium means a medium containing water as a main component.

In the present invention, a dispersion stabilizer is preferably added to the aqueous medium. Examples of the dispersion stabilizer include: inorganic compounds including sulfates such as barium sulfate and calcium sulfate, carbonates such as barium carbonate, calcium carbonate and magnesium carbonate, phosphates such as calcium phosphate, metal oxides such as aluminum oxide and titanium oxide, and metal hydroxides such as aluminum hydroxide, magnesium hydroxide and iron (II) hydroxide; and organic compounds including water-soluble polymers such as polyvinyl alcohol, methyl cellulose and gelatin, anionic surfactants, nonionic surfactants and ampholytic surfactants. These dispersion stabilizers can be used alone or in combination of two or more kinds.

Among the above dispersion stabilizers, colloid of inorganic compounds, particularly hardly water-soluble metal hydroxide, is preferable. By using the colloid of inorganic compounds, particularly hardly water-soluble metal hydroxide, the colored resin particles can have a small particle size distribution, so that the amount of the dispersion stabilizer remained after washing is small, thus the image can be clearly reproduced by the polymerized toner to be obtained; moreover, environmental stability cannot be deteriorated.

(A-3) Polymerization Process

The droplets are formed as described in the above (A-2), and thus obtained aqueous dispersion medium is heated to polymerize. Thereby, an aqueous dispersion liquid of colored resin particles is formed.

The polymerization temperature of the polymerizable monomer composition is preferably 50° C. or more, more preferably in the range from 60 to 95° C. The polymerization reaction time is preferably in the range from 1 to 20 hours, more preferably from 2 to 15 hours.

The colored resin particles may be used as a polymerized toner obtained by adding an external additive. It is preferable that the colored resin particles are so-called core-shell type (or "capsule type") colored resin particles which are obtained by using the colored resin particles as a core layer and forming a shell layer, a material of which is different from that of the core layer, around the core layer. The core-shell type colored resin particles cover the core layer including a substance having a low-softening point with a substance having a high-softening point, thereby taking a balance of lowering of fixing temperature and prevention of blocking at storage.

A method for producing the above-mentioned core-shell type colored resin particles using the colored resin particles is not particularly limited, and can be produced by any conventional method. The in situ polymerization method and the phase separation method are preferable from the viewpoint of production efficiency.

A method for producing the core-shell type colored resin particles according to the in situ polymerization method will be hereinafter described.

A polymerizable monomer (a polymerizable monomer for shell) and polymerization initiator for forming a shell layer are added to an aqueous medium to which the colored resin particles are dispersed followed by polymerization, thus the core-shell type colored resin particles can be obtained.

As the polymerizable monomer for shell, the above-mentioned polymerizable monomer can be used. Among the polymerizable monomers, any of monomers which provide a polymer having Tg of more than 80° C. such as styrene, acrylonitrile and methyl methacrylate is preferably used alone or in combination of two or more kinds.

Examples of the polymerization initiator used for polymerization of the polymerizable monomer for shell include: water-soluble polymerization initiators including metal persulfates such as potassium persulfate and ammonium persulfate; and azo compounds such as 2,2'-azobis(2-methyl-N-(2-hydroxyethyl)propionamide) and 2,2'-azobis(2-methyl-N-(1,1-bis(hydroxymethyl)-2-hydroxy ethyl)propionamide). These polymerization initiators can be used alone or in combination of two or more kinds. The amount of the polymerization initiator is preferably in the range from 0.1 to 30 parts by weight, more preferably from 1 to 20 parts by weight, with respect to 100 parts by weight of the polymerizable monomer for shell.

The polymerization temperature of the shell layer is preferably 50° C. or more, more preferably in the range from 60 to 95° C. The polymerization reaction time is preferably in the range from 1 to 20 hours, more preferably from 2 to 15 hours.

(A-4) Processes of Washing, Filtering, Dehydrating and Drying

It is preferable that the aqueous dispersion liquid of the colored resin particles obtained by the polymerization is subjected to operations including filtering, washing for removing the dispersion stabilizer, dehydrating, and drying several times as needed after the polymerization, according to any conventional method.

In the washing method, if the inorganic compound is used as the dispersion stabilizer, it is preferable that acid or alkali is added to an aqueous dispersion liquid of colored resin particles; thereby, the dispersion stabilizer is dissolved in water and removed. If colloid of hardly water-soluble inorganic hydroxide is used as the dispersion stabilizer, it is preferable to control pH of the aqueous dispersion liquid of colored resin particles to 6.5 or less. Examples of the acid to be added include inorganic acids such as sulfuric acid, hydrochloric acid and nitric acid, and organic acids such as formic acid and acetic acid. Particularly, sulfuric acid is suitable for high removal efficiency and small impact on production facilities.

The methods for dehydrating and filtering are not particularly limited, and several kinds of known methods can be used. Examples of the filtration method include a centrifugal filtration method, a vacuum filtration method and a pressure filtration method. Also, the drying method is not particularly limited, and several kinds of methods can be used.

(B) Pulverization Method

In the case of producing the colored resin particles by employing the pulverization method, the following processes are performed.

First, a binder resin, a colorant, a release agent, a retention aid and other additives such as a charge control agent, which are added if required, are mixed by means of a mixer such as a ball mill, a V type mixer, Henschel Mixer (product name), a high-speed dissolver, an internal mixer or a whole burg internal mixer. Next, the above-obtained mixture is kneaded while heating by means of a press kneader, a twin screw kneading machine or a roller. The obtained kneaded product is coarsely pulverized by means of a pulverizer such as a hammer mill, a cutter mill or a roller mill, followed by finely pulverizing by means of a pulverizer such as a jet mill or a high-speed rotary pulverizer, and classifying into desired particle diameters by means of a classifier such as a wind classifier or an airflow classifier. Thus, colored resin particles produced by the pulverization method can be obtained.

The binder resin, the colorant, the release agent, the retention aid and other additives such as the charge control agent, which are added if required, used in "(A) Suspension polymerization method" can be used in the pulverization method. Similarly as the colored resin particles obtained by "(A) Suspension polymerization method", the colored resin particles obtained by the pulverization method can also be in a form of the core-shell type colored resin particles produced by a method such as the in situ polymerization method.

As the binder resin, other resins which are conventionally and broadly used for the toner can be used. Specific examples of the binder resin used in the pulverization method include polystyrene, styrene-butyl acrylate copolymers, polyester resins and epoxy resins.

2. Colored Resin Particles

Colored resin particles are obtained by the above production method such as (A) Suspension polymerization method or (B) Pulverization method.

Colored resin particles constituting the toner will be hereinafter described. Hereinafter, the colored resin particles include both core-shell type colored resin particles and colored resin particles which are not core-shell type.

The volume average particle diameter (Dv) of the colored resin particles is preferably in the range from 4 to 12 μm, more preferably from 5 to 10 μm. If the volume average particle diameter (Dv) of the colored resin particles is less than 4 μm, flowability of the toner lowers, transferability deteriorates, and image density may decrease. If the volume average particle diameter (Dv) of the colored resin particles exceeds 12 μm, the resolution of images may decrease.

As for the colored resin particles, a ratio (particle size distribution (Dv/Dn)) of the volume average particle diameter (Dv) and the number average particle size (Dn) is preferably in the range from 1.0 to 1.3, more preferably from 1.0 to 1.2. If "Dv/Dn" exceeds 1.3, transferability, image density and resolution may decrease. The volume average particle diameter and the number average particle size of the colored resin particles can be measured, for example, by means of a particle diameter measuring device (product name: MULTISIZER; manufactured by Beckman Coulter, Inc.), etc.

The average circularity of the colored resin particles of the present invention is preferably in the range from 0.96 to 1.00, more preferably from 0.97 to 1.00, further more preferably from 0.98 to 1.00, from the viewpoint of image reproducibility.

If the average circularity of the colored resin particles is less than 0.96, the reproducibility of thin lines may decrease.

In the present invention, circularity is a value obtained by dividing a perimeter of a circle having an area same as a projected area of a particle by a perimeter of a projected particle image. Also, in the present invention, an average circularity is used as a simple method of quantitatively presenting shapes of particles and is an indicator showing the level of convexo-concave shapes of the colored resin particles. The average circularity is "1" when each of the colored resin particles is an absolute sphere, and the value becomes smaller as the shape of the surface of each of the colored resin particles becomes more complex.

The colored resin particles preferably have positively charging ability. If the colored resin particles having negatively charging ability are used, the charge amount of the toner decreases and fog is likely to occur.

3. Method for Producing Toner of the Present Invention

In the present invention, the colored resin particles can be used as a toner without any change. From the viewpoint of controlling the charging ability, flowability and shelf stability of the toner, it is preferable that the colored resin particles are mixed and agitated together with an external additive; thus, the external additive is attached on the surface of the colored resin particles to form a one-component toner (developer).

The one-component toner may be mixed and agitated together with carrier particles to form a two-component developer.

The agitator for adding an external additive to colored resin particles is not particularly limited as long as it is an agitator capable of attaching the external additive on the surface of the colored resin particles. The examples include agitators capable of mixing and agitating, such as FM Mixer (product name; manufactured by NIPPON COKE & ENGINEERING CO., LTD.), SUPER MIXER (product name; manufactured by KAWATA MFG Co., Ltd.), Q MIXER (product name;

manufactured by NIPPON COKE & ENGINEERING CO., LTD.), Mechanofusion system (product name; manufactured by Hosokawa Micron Corporation) and MECHANOMILL (product name; manufactured by OKADA SEIKO CO., LTD.). The external additive can be added to the colored resin particles by means of the above agitators.

Examples of the external additive include: inorganic particles comprising silica, titanium oxide, aluminum oxide, zinc oxide, tin oxide, calcium carbonate, calcium phosphate and/or cerium oxide; and organic particles comprising polymethymethacrylate, silicone resin and/or melamine resin. Among them, inorganic particles are preferable. Among the inorganic particles, silica and/or titanium oxide is preferable, and particles comprising silica are more preferable.

These external additives are used alone, or in combination of two or more kinds. In particular, it is preferable to use two or more kinds of silica having a different particle diameter in a combination.

In the present invention, it is desirable that the amount of the external additive to be used is generally in the range from 0.05 to 6 parts by weight, preferably from 0.2 to 5 parts by weight, with respect to 100 parts by weight of the colored resin particles. If the added amount of the external additive is less than 0.05 part by weight, the toner after transfer may be remained. If the added amount of the external additive exceeds 6 parts by weight, fog may occur.

4. Toner of the Present Invention

The toner of the present invention obtained as a result of the above-mentioned processes comprises a retention aid which comprises a styrene monomer and a (meth)alkyl acrylate monomer and has a glass transition temperature in a specific range; thereby, the toner has excellent heat-resistant shelf stability, low-temperature fixability and hot offset resistance, and provides a smooth printing surface and high-gloss printouts.

EXAMPLES

Hereinafter, the present invention will be described further in detail with reference to examples and comparative examples. However, the scope of the present invention may not be limited to the following examples. Herein, "part(s)" and "%" are based on weight if not particularly mentioned.

Test methods used in the examples and the comparative examples are as follows.

1. Production of Toner for Developing Electrostatic Images

Example 1

77 parts styrene and 23 parts n-butyl acrylate as monovinyl monomers, 7 parts carbon black (product name: #25B; manufactured by Mitsubishi Chemical Corporation) as a black colorant, 0.68 part divinylbenzene as a crosslinkable polymerizable monomer, 1.2 parts t-dodecyl mercaptan as a molecular weight modifier and 0.25 part polymethacrylic acid ester macromonomer (product name: AA6; manufactured by Toagosei Co., Ltd.) as a macromonomer were wet-pulverized by means of a media type wet pulverizer. Thereto, 1 part charge control resin having positively charging ability (quaternary ammonium group-containing styrene/acrylic copolymer) as a charge control agent, 5 parts hexaglycerin octabehenate (acid value: 0.5 mg KOH/g; hydroxyl value: 0.5 mg KOH/g) and 2 parts paraffin wax (product name: HNP-11; manufactured by Nippon Seiro Co., Ltd.) as release agents, and 5 parts retention aid A (sample name: ARUFON 1150-1; manufactured by Toagosei Co., Ltd.) were added and mixed. Thus, a polymerizable monomer composition was obtained.

Separately, in an agitating chamber, an aqueous solution of 4.1 parts sodium hydroxide dissolved in 50 parts ion-exchanged water was gradually added to an aqueous solution of 7.4 parts magnesium chloride dissolved in 250 parts ion-exchanged water at room temperature while agitating to prepare a magnesium hydroxide colloid dispersion liquid (3.0 parts magnesium hydroxide).

The polymerizable monomer composition was charged into the above-obtained magnesium hydroxide colloid dispersion liquid and agitated at room temperature until the droplets were stable. Then, 5 parts t-butylperoxy-2-ethylhexanoate (product name: PERBUTYL O; manufactured by NOF Corporation) as a polymerization initiator was added therein followed by being subjected to a high shear agitation at 15,000 rpm by means of an in-line type emulsifying and dispersing machine (product name: EBARA MILDER; manufactured by Ebara Corporation). Thus, droplets of the polymerizable monomer composition were formed.

The suspension having the above-obtained droplets of the polymerization monomer composition dispersed (a polymerizable monomer composition dispersion liquid) was charged into a reactor furnished with an agitating blade and the temperature thereof was raised to 90° C. to start a polymerization reaction. When the polymerization conversion reached almost 100%, 1.5 parts methyl methacrylate (a polymerizable monomer for shell) and 0.15 part 2,2'-azobis (2-methyl-N-(2-hydroxyethyl)-propionamide) (a polymerization initiator for shell; product name: VA-086; manufactured by Wako Pure Chemical Industries, Ltd.; water-soluble) dissolved in 20 parts ion-exchanged water were added in the reactor. After continuing the polymerization for another 3 hours at 90° C., the reactor was cooled by water to stop the reaction. Thus, an aqueous dispersion of colored resin particles was obtained.

The above-obtained aqueous dispersion of colored resin particles was subjected to acid washing in which sulfuric acid was added dropwise to be pH of 6.5 or less while agitating at room temperature. Then, separation by filtration was performed, and thus a solid content was obtained. The resultant solid content was subjected to water washing treatment (washing, filtration and dehydration) several times in which another 500 parts ion-exchanged water was added to the above-obtained solid content to make a slurry again. Next, separation by filtration was performed and the thus-obtained solid content was placed in a container of a dryer for drying at 45° C. for 48 hours. Thus, dried colored resin particles were obtained.

To 100 parts of the above-obtained colored resin particles, 0.7 part of silica particles A having a number average primary particle diameter of 10 nm and 1 part of silica particles B having a number average primary particle diameter 55 nm, which are hydrophobized with amino modified silicone oil were added to mix by means of a high speed agitator (product name: Henschel Mixer; manufactured by NIPPON COKE & ENGINEERING CO., LTD.), and the external additives were externally added. Thus, a toner for developing electrostatic images of Example 1 was produced.

Example 2

A toner for developing electrostatic images of Example 2 was produced similarly as in Example 1 except that 5 parts retention aid B (sample name: ARUFON 1150-2; manufactured by Toagosei Co., Ltd.) was added instead of 5 parts retention aid A.

Example 3

A toner for developing electrostatic images of Example 3 was produced similarly as in Example 1 except that 10 parts retention aid B was added instead of 5 parts retention aid A.

Comparative Example 1

A toner for developing electrostatic images of Comparative example 1 was produced similarly as in Example 1 except that 5 parts retention aid C (sample name: ARUFON UP-1150; manufactured by Toagosei Co., Ltd.) was added instead of 5 parts retention aid A.

Comparative Example 2

A toner for developing electrostatic images of Comparative example 2 was produced similarly as in Example 1 except that 5 parts retention aid D (sample name: ARUFON UP-1080; manufactured by Toagosei Co., Ltd.) was added instead of 5 parts retention aid A.

TABLE 1

| | | Example 1 | Example 2 | Example 3 | Comparative example 1 | Comparative example 2 |
|---|---|---|---|---|---|---|
| Retention aid | Type of retention aid | Retention aid A | Retention aid B | Retention aid B | Retention aid C | Retention aid D |
| | Added amount of retention aid (part) | 5 | 5 | 10 | 5 | 5 |
| Characteristics of particle diameter of colored resin particles | Volume average particle diameter (Dv) (μm) | 7.5 | 7.5 | 7.5 | 7.5 | 7.5 |
| | Particle size distribution (Dv/Dn) | 1.12 | 1.12 | 1.12 | 1.13 | 1.13 |
| | Average circularity | 0.98 | 0.98 | 0.98 | 0.98 | 0.98 |

2. Property Evaluation of Colored Resin Particles

The characteristics of the particle diameter of the colored resin particles used for the toner of Examples 1 to 3 and Comparative examples 1 and 2 were examined. The details are as follows.

2-1. Measurement of Volume Average Particle Diameter (Dv) and Number Average Particle Size (Dn), and Calculation of Particle Size Distribution (Dv/Dn)

About 0.1 g of colored resin particles was weighed out and placed in a beaker. Then, 0.1 mL aqueous solution of alkyl benzene sulfonate (product name: DRIWEL; manufactured by FUJIFILM Corporation) was added therein as a dispersant. Further, from 10 to 30 mL of an electrolyte solution for measurement (product name: ISOTON II-PC; manufactured by Beckman Coulter, Inc.) was added to the beaker and dispersed by means of an ultrasonic disperser at 20 W (watts) for 3 minutes. Then, the volume average particle diameter (Dv) and number average particle diameter (Dn) of the colored resin particles were measured by means of a particle diameter measuring device (product name: MULTISIZER; manufactured by Beckman Coulter, Inc.) under the condition of an aperture diameter of 100 μm, using ISOTON II-PC as a medium, and a number of the measured particles of 100,000. Therefrom, the particle size distribution (Dv/Dn) was calculated.

2-2. Calculation of Average Circularity 10 mL ion-exchanged water was preliminarily filled with a container, and 0.02 g surfactant (alkyl benzene sulfonate) as a dispersant and 0.02 g colored resin particle were added to the container. Then, dispersion treatment was performed by means of an ultrasonic disperser at 60 W (watts) for 3 minutes. The concentration of colored resin particles was adjusted to be 3,000 to 10,000 particles/μL during measurement, and 1,000 to 10,000 colored resin particles having a diameter of 0.4 μm or more by a diameter of the equivalent circle were subjected to measurement by means of a flow particle image analyzer (product name: FPIA-2100; manufactured by SYSMEX CORPORATION). The average circularity was calculated from measured values thus obtained.

Circularity can be calculated by the following Calculation formula 1, and the average circularity is an average of the calculated circularities:

Circularity=a perimeter of a circle having an area same as a projected area of a particle/a perimeter of a projected image of a particle Calculation formula 1:

The characteristics of the particle diameter of the colored resin particles used for the toner of Examples 1 to 3 and Comparative examples 1 and 2 are shown in Table 1, together with the kind and the content of the retention aid contained in each of the colored resin particles.

3. Property Evaluation of Retention Aid

The GPC and glass transition temperature of retention aids A to D were measured. The details of the measurement are as follows.

3-1. Measurement of GPC, and Calculation of Weight Average Molecular Weight (Mw), Number Average Molecular Weight (Mn) and Molecular Weight Distribution (Mn/Mw)

First, retention aids A to D of 0.1 g were weighed out and placed in 100 mL glass sample bottles. Then, 49.9 g THF was placed in each bottle. Next, a stirrer chip was placed in each bottle and agitated at room temperature for 1 hour by means of a magnetic stirrer to dissolve a binder resin, etc. Thus, dispersion liquids were obtained. Then, the thus-obtained dispersion liquids were each filtered with a 0.2 μm thick PTFE filter to obtain THF solutions. Finally, 100 μL of each of the thus-obtained THF solutions was injected into a GPC measuring device to measure GPC. Weight average molecular weight (Mw), number average molecular weight (Mn) and molecular weight distribution (Mn/Mw) were calculated from a calibration curve in terms of commercially available monodisperse standard polystyrene, based on the dissolution curve of each of the obtained GPCs.

(Gpc Measurement Condition)

GPC: HLC-8220 (manufactured by Tosoh Corporation)

Column: Two directly connected columns of TSK-GEL MULTIPORE HXL-M (manufactured by Tosoh Corporation)

Eluent: THF

Flow rate: 1.0 mL/min

Temperature: 40° C.

3-2. Measurement of Glass Transition Temperature (° C.)

The glass transition temperature of the retention aid was measured with reference to ASTM D3418-82. More specifically, a sample was heated at a heating rate of 10° C./minute by means of Differential Scanning calorimetry, and the temperature which shows the glass transition temperature in a DSC curve obtained through the above heating process was measured. As the Differential Scanning calorimetry, SSC5200 (product name; manufactured by SEICO Electronics industrial Co., Ltd.) was used.

The measurement and evaluation results of retention aids A to D are shown Table 2, together with the composition of each of the retention aids.

TABLE 2

| | Retention aid A | Retention aid B | Retention aid C | Retention aid D |
|---|---|---|---|---|
| Content ratio of styrene monomer (%) | 90 | 80 | 100 | 0 |
| Content ratio of butylacrylate monomer (%) | 10 | 20 | 0 | 100 |
| Weight average molecular weight (Mw) of copolymer | 4470 | 4160 | 5000 | 6000 |
| Number average molecular weight (Mn) of copolymer | 3440 | 3210 | 3560 | 4010 |
| Molecular weight distribution (Mw/Mn) of copolymer | 1.3 | 1.3 | 1.4 | 1.5 |
| Glass transition temperature (° C.) | 42 | 26 | 68 | −60 |

4. Property Evaluation of Toner

The characteristics of the toner for developing electrostatic images of Examples 1 to 3 and Comparative examples 1 and 2 were examined. The details are as follows.

4-1. Evaluation of Shelf Stability 10 g of a toner was placed in a sealable polyethylene container (capacity: 100 mL), and the container was sealed. Then, the container was set in a constant temperature water bath which is maintained at a temperature of 55° C. After 8 hours, the container was removed from the constant temperature water bath, and the toner in the container was put on a 42-mesh sieve. At this time, the toner was gently removed from the container and carefully put on the sieve so as not to destroy the aggregation structure of the toner in the container.

The sieve on which the toner was put was vibrated for 30 seconds under the condition of amplitude of 1 mm by means of a powder characteristic tester (product name: POWDER TESTER PT-R; manufactured by Hosokawa Micron Corporation). Thereafter, the weight of the toner remained on the sieve was measured, and the thus-measured toner was referred to as an aggregated toner weight. The ratio (% by weight) of the aggregated toner weight to the toner weight which was firstly placed in the container was calculated.

The above measurement was performed three times per sample to calculate the ratio (% by weight) of the aggregated toner weight, and the mean value of thus obtained ratio was referred to as an indicator of shelf stability.

4-2. Measurement of Minimum Fixing Temperature and Hot Offset Temperature

A commercially available printer of the non-magnetic one-component developing method, which was refurbished so that the temperature of a fixing roller section of the printer was changed, was used for a fixing test. 100 g of a toner was charged in a toner cartridge of a development device of the printer and printing paper was set in the printer. The fixing test was performed as described below.

In the fixing test, a solid patterned image with 100% printing density was printed, the temperature of the fixing roller in the refurbished printer was changed by 5° C., and then the fixing rate of the toner was measured at each temperature to determine the relationship between the temperature and fixing rate.

At each temperature changed by 5° C., the temperature was kept for 5 minutes or more in order to stabilize the temperature of the fixing roller.

A tape was removed in the area of the solid patterned image with 100% printing density. The fixing rate was calculated from the ratio of image density before and after removing the tape. In particular, if the image density before removing the tape is referred to as ID (before) and the image density after removing the tape is referred to as ID (after), the fixing rate can be calculated from the following Calculating formula 2:

$$\text{Fixing rate (\%)}=(\text{ID(after)}/\text{ID(before)})\times 100 \quad \text{Calculating formula 2:}$$

Tape removing operation means a series of operations including: attaching an adhesive tape (product name: SCOTCH MENDING TAPE 810-3-18; manufactured by Sumitomo 3M Limited) to a measuring part of a test paper to be adhered by pressure by means of a disk-shaped metal roller (diameter 15 cm×thickness 2 cm; weight: 1 kg) at a constant pressure; and removing the adhesive tape in a direction along the paper at a constant rate. The image density was measured by means of a reflection image densitometer (product name: RD914; manufactured by Gretag Macbeth Co.).

In the above fixing test, the minimum fixing roller temperature at which the fixing rate is 80% or more was referred to as the minimum fixing temperature of the toner. In addition, a hot offset temperature is the temperature at which residual fouling resulted from the toner by offset was confirmed on the fixing roller as a result of raising the temperature by 5° C. The test of hot offset was performed up to 240° C. In Tables, "240<" means that hot offset was not caused even at 240° C.

4-3. Gloss Evaluation

The printer was adjusted so that the amount of toner on a paper with solid images becomes 0.45 (mg/cm$^2$), and then 5 cm square solid images were printed on a paper (product name: Laser Print Paper 24; manufactured by Hammer Mill) by changing the temperature (fixing temperature) of the fixing roller by 10° C. in the range from 170 to 200° C. The gloss value of the thus-obtained 5 cm square solid images was measured by means of a gloss meter (product name: VGS-SENSOR; manufactured by Nippon Denshoku Industries Co., Ltd.) at an incident angle of 60°. The higher the gloss value, the higher the glossy appearance.

The measurement and evaluation results of the toner for developing electrostatic images of Examples 1 to 3 and Comparative examples 1 and 2 are shown in Table 3, together with the kind and the content of each of the retention aids.

TABLE 3

| | | | Example 1 | Example 2 | Example 3 | Comparative example 1 | Comparative example 2 |
|---|---|---|---|---|---|---|---|
| Retention aid | Type | | Retention aid A | Retention aid B | Retention aid B | Retention aid C | Retention aid D |
| | Added amount (part) | | 5 | 5 | 10 | 5 | 5 |
| Characteristics of toner | Shelf stability (%) | | 0.1 | 0.1 | 0.1 | 0.1 | 0.1 |
| | Minimum fixing temperature (° C.) | | 135 | 135 | 130 | 150 | 145 |
| | Hot offset temperature (° C.) | | 240< | 240< | 240< | 240< | 200 |
| | Gloss | 170° C. | 8 | 8 | 10 | 3 | 7 |
| | | 180° C. | 10 | 11 | 12 | 6 | 8 |
| | | 190° C. | 12 | 15 | 15 | 8 | 6 |
| | | 200° C. | 14 | 13 | 14 | 9 | 3 |

5. Summary of Toner Evaluation

Hereinafter, the toner evaluation will be reviewed with reference to Tables 1 to 3.

First, the toner of Comparative example 1 will be reviewed. From the evaluation results described in Tables 2 and 3, it can be understood that retention aid C contained in the toner of Comparative example 1 is a copolymer comprising only a styrene monomer and has a glass transition point of 68° C.

From the evaluation results described in Table 3, it can be understood that the toner of Comparative example 1 has an aggregated toner ratio of 0.1% by weight and a hot offset temperature of more than 240° C. Therefore, the toner of Comparative example 1 has no problem with at least shelf stability and hot offset resistance.

However, the toner of Comparative example 1 has a high minimum fixing temperature of 150° C. and a low gloss value at each temperature in the range from 170 to 200° C. in particular, the toner of Comparative example 1 has a gloss value of 3 at 170° C. This result is the lowest value among the toners of Examples 1 to 3 and Comparative examples 1 and 2. Therefore, it can be understood that the toner of Comparative example 1 provides a particularly-low glossy appearance at a relatively-low fixing temperature.

Next, the toner of Comparative example 2 will be reviewed. From the evaluation results described in Tables 2 and 3, it can be understood that retention aid D contained in the toner of Comparative example 2 is a copolymer comprising only a (meth)alkyl acrylate monomer and has a glass transition point of −60° C.

From the evaluation results described in Table 3, the toner of Comparative example 2 has an aggregated toner ratio of 0.1% by weight. Therefore, the toner of Comparative example 2 has no problem with at least shelf stability.

However, the toner of Comparative example 2 has a hot offset temperature of 200° C., a high minimum fixing temperature of 145° C., and a low gloss value at each temperature in the range from 170 to 200° C. In particular, the toner of Comparative example 2 has a gloss value of 3 at 200° C. This result is the lowest value among the toners of Examples 1 to 3 and Comparative examples 1 and 2. Therefore, it can be understood that the toner of Comparative example 2 provides a particularly-low glossy appearance at a relatively-high fixing temperature.

On the other hand, from the evaluation results described in Tables 2 and 3, it can be understood that retention aid A contained in the toner of Example 1 is a copolymer comprising 90% by weight styrene monomer and 10% by weight (meth)alkyl acrylate monomer, and has a glass transition point of 42° C. In addition, from the evaluation results described in Tables 2 and 3, it can be understood that retention aid B contained in the toner of Example 2 is a copolymer comprising 80% by weight styrene monomer and 20% by weight (meth)alkyl acrylate monomer, and has a glass transition point of 26° C. Retention aid B in the toner of Example 3 is 5 parts more than that of Example 2.

From the evaluation results described in Table 3, it can be understood that the toner of Examples 1 to 3 has an aggregated toner ratio of 0.1% by weight, a hot offset temperature of more than 240° C., a low minimum fixing temperature of 130 to 135° C., and a high gloss value at each temperature in the range from 170 to 200° C.

Therefore, it can be understood that the toner of the present invention comprises the retention aid which is a copolymer of 70 to 98% by weight styrene monomer and 2 to 30% by weight (meth)alkyl acrylate monomer, and has a glass transition temperature of 5 to 60° C., thereby having excellent heat-resistant shelf stability, low-temperature fixability and hot offset resistance, and providing a smooth printing surface and high-gloss printouts.

What is claimed is:

1. A toner for developing electrostatic images, comprising a binder resin, a colorant, a release agent, a charge control agent, and a retention aid, wherein the retention aid is a copolymer of 70 to 98% by weight styrene and 2 to 30% by weight (meth)alkyl acrylate, and the copolymer has a glass transition temperature of 5 to 60° C., wherein an added amount of the retention aid is in the range from 1 to 15 parts by weight with respect to 100 parts by weight of the binder resin, wherein the retention aid has a weight average molecular weight (Mw) of 3,000 to 10,000 and a molecular weight distribution (Mw/Mn) of 1.0 to 2.0, which is a ratio of weight average molecular weight (Mw) to number average molecular weight (Mn).

2. The toner for developing electrostatic images according to claim 1, wherein the release agent contains an ester wax.

3. The toner for developing electrostatic images according to claim 2, wherein the ester wax is a polyfunctional ester wax having an acid value of 2 mg KOH/g or less and a hydroxyl value of 15 mg KOH/g or less.

4. The toner for developing electrostatic images according to claim 1, wherein the release agent contains a hydrocarbon wax.

* * * * *